United States Patent [19]

Hsieh

[11] Patent Number: 4,703,402

[45] Date of Patent: Oct. 27, 1987

[54] FLASH LIGHT WITH ALARM AND RESCUER

[76] Inventor: Webert Hsieh, Room 4, 12th Fl., No. 342, Fu Shin S. Road, Sec. 1 Taipei, Taiwan

[21] Appl. No.: 889,077

[22] Filed: Jul. 24, 1986

[51] Int. Cl.[4] ..... A45B 3/02; A63B 15/02

[52] U.S. Cl. ..... 362/102; 362/183; 362/205; 362/253; 340/384 R; 231/2 E

[58] Field of Search ..... 362/102, 183, 184, 205, 362/206, 253; 340/384 R; 231/2 E

[56] References Cited

U.S. PATENT DOCUMENTS

| | | | |
|---|---|---|---|
| 2,208,852 | 7/1940 | Mongan | 362/102 |
| 2,908,901 | 10/1959 | Lewis | 340/384 R |
| 4,357,648 | 11/1982 | Nelson | 362/183 |
| 4,535,391 | 8/1985 | Hsiao | 362/184 |

*Primary Examiner*—James C. Yeung

*Attorney, Agent, or Firm*—Lowe, Price, LeBlanc, Becker & Shur

[57] ABSTRACT

Disclosed herein is a flash light with alarm and rescuer having a transparent hood at the front end. The transparent hood is incorporated with a lens, a reflective board, a color reflector and a control block in it and a plurality of electrodes and conductors along its circumference. The transparent hood is fixed to a regulator and then a fixing block. Extension and extraction of the electrodes are controlled by the regulator. The electrodes can give electric shock by pushing their corresponding button 44. Volume of alarm is controlled by a volume regulator below the fixing block by adjusting opening a hole of resonance, and lighting or blinking of the light is controlled by means of a button.

6 Claims, 4 Drawing Figures

FLASH LIGHT WITH ALARM AND RESCUER

BACKGROUND OF THE INVENTION

Generally a flash light is merely for lighting only. For a guard at night shift, he has to take a flash light and some certain defensive weapons. If a defensive weapon is not available, he will be unable to protect himself or call for help if he encounters any attack. In view of these defects, a flash light with alarm and rescuer was created.

The present invention provides a flash light with alarm and rescuer. It is characterized by its functions of: (1) lighting, with a plurality of ridges on a reflector to increase intensity of light; (2) alarm, to call for help or to indicate way of escape; (3) blinking light as a signal for help at sea or mountain; and (4) electric shock as a defensive weapon.

SUMMARY OF THE INVENTION

The present invention provides a flash light with alarm and rescuer, particularly a flashlight with multiple functions: alarming, electric shock, SOS signal, lighting, etc. It is a flash light with a transparent hood in the front end. The transparent hood is incorporated with a lens, a reflective board, a color reflector, and a control bulb in it for lighting and blinking. A plurality of electrodes and conductors are placed around the transparent hood. The conductors are to provide high voltage to surface of the transparent hood or the electrodes. The transparent hood is connected to a regulator which is designed to control extension and retraction of the electrodes. A volume regulator is incorporated to control volume of alarm. Power to the electrodes is turned on and off by a button for giving electric shock timely. Alarm is activated by a button and blinking of the bulb is controlled by another button. A socket and charging circuit is incorporated for charging batteries.

DESCRIPTION OF THE PREFERRED EMBODIMENT

Figure 1:
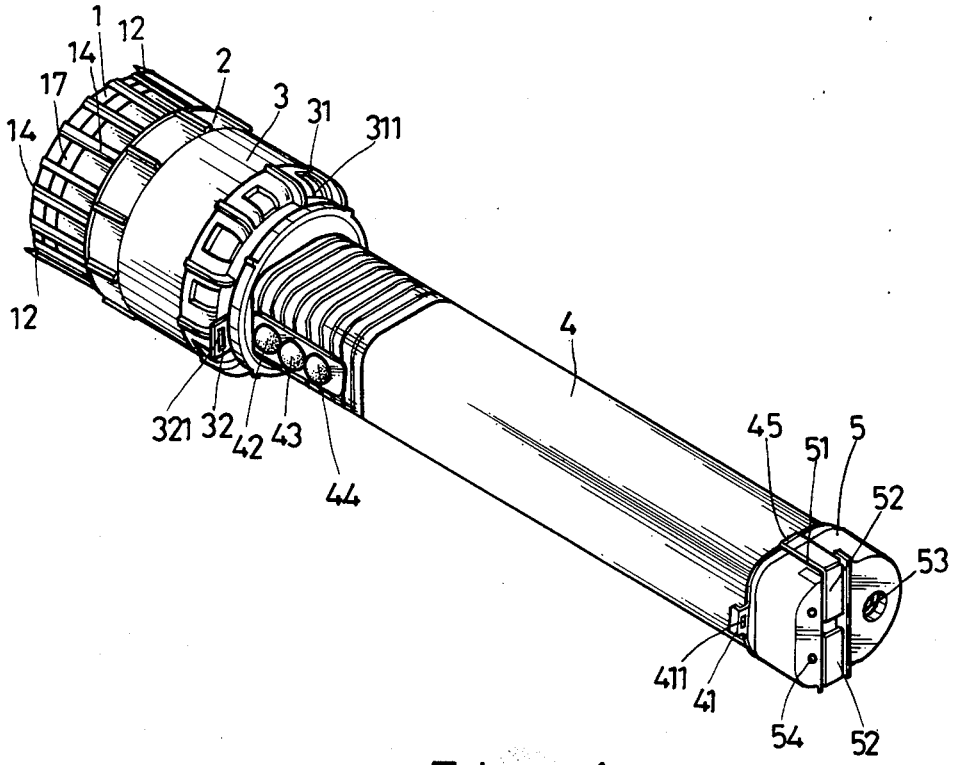
FIG. 1 is a perspective view illustrating an embodiment according to the present invention.

As shown in FIG. 1, a perspective view of an embodiment according to the present invention, a transparent hood (1) is used for emission of light. A regulator (2) below the transparent hood (1) is for controlling extension and retraction of electrodes (12). Under the regulator (2) a fixing block (3) with a volume regulator (31) is placed. The volume regulator (31) is for control over volume of alarm to be given. A support (32) with strip fastening hole (321) for fastening of a strip is placed below the fixing block (3). The fixing block (3) is connected to a handle (4) and fixed to a support (41) with a strip fastening hole (411) for fastening of the strip at the end. The strip is fastened for hanging on human body. The handle (4) has three buttons (42, 43, and 44). The button (42) is a switch for the electrode, the button (43) is a switch for an alarm, and the button (44) is a switch for lighting and blinking. The handle (4) is hollow for containing batteries, and has a battery chamber cover (5) at its end.

Figure 2:
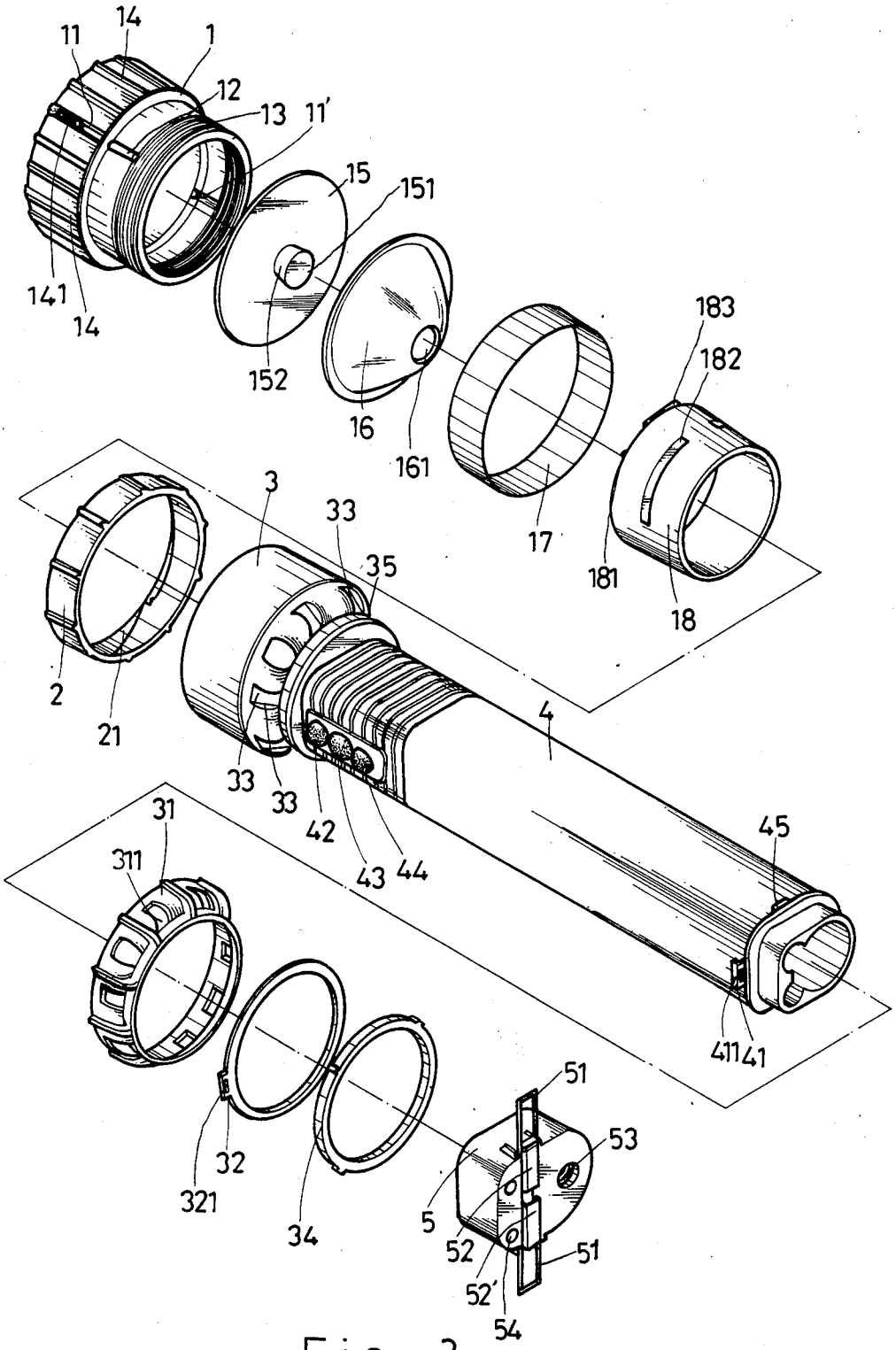
FIG. 2 is a exploded view of the embodiment according to the present invention.
Figure 2A:
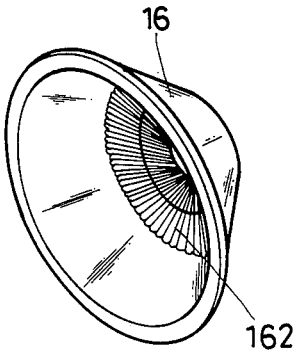
FIG. 2*a* is a perspective view illustrating a reflective board according to the present invention.

Please refer to FIG. 2, a fragmental exploded view of the embodiment according to the present invention. The transparent hood (1) has two pins holes (11 and 11') for installation of two electrodes (12) in the form of neddle to ease penetration into thick clothes and application of electric shock. The rear end of the transparent hood (1) has a thread (13) for connecting to the fixing block (3). A plurality of electric conductors (14) is plated at the front end of the transparent hood (1) so that electricity can be conducted to circumference of the transparent hood (1). The conductors (14) are extended from outside to inside in order to contact with high voltage output contact for giving electric shock. The transparent hood (1) is incorporated with a lens (15), a reflective hood (16), a color reflector (17) and a control block (18) for a bulb (181) to pass through a bulb hole (161). The lens (15) according to the present invention has a V-seat (151) having a recession (152) so that light from the bulb (181) can be reflected to the reflective hood (16) for reflection. An embodiment of reflective hood (16) according to the present invention is shown in FIG. 2*a*, a perspective view of the reflective hood (16). It has a plurality of equidistant ridges (162) in two layers and equal arc arrangement for convergence of light before reflection in order to intensify the light.

As shown in FIG. 2, the color reflector (17) behind the reflective hood (16) is to give blinking light in color by reflecting light from a flasher (183) to used as an SOS signal.

The control block (18) has a bulb (181) at the front side and a conductive metal plate (182) to turn on the bulb (181) by contacting with the conductors (14). Voltage rise by oscillation is of a common circuit and it is not within the claim hereof, description of which is thus not included in this specification.

The regulator (2) according to the present invention has an oblique control slot (21) to control extension and retraction of electrode (12). The electrode (12) has a spring (141) at the upper end and a curved protrusion (121) at the lower end so that turning of the regulator (2) can extend or retract the electrode.

An appropriate space is designed below the control block (18) for installation of a speaker with the fixing block (3) as a resonant cavity. Volume of the speaker diminishes while the volume regulator (31) is turned inwards, and is maximized by aligning a hole (311) on the volume regulator (31) with a hole (33) of the fixing block (3).

The volume regulator (31) is connecting to the support (32) below it and fixed to the lower end (35) of the fixing block (3) by means of a ring (34).

Figure 2B:
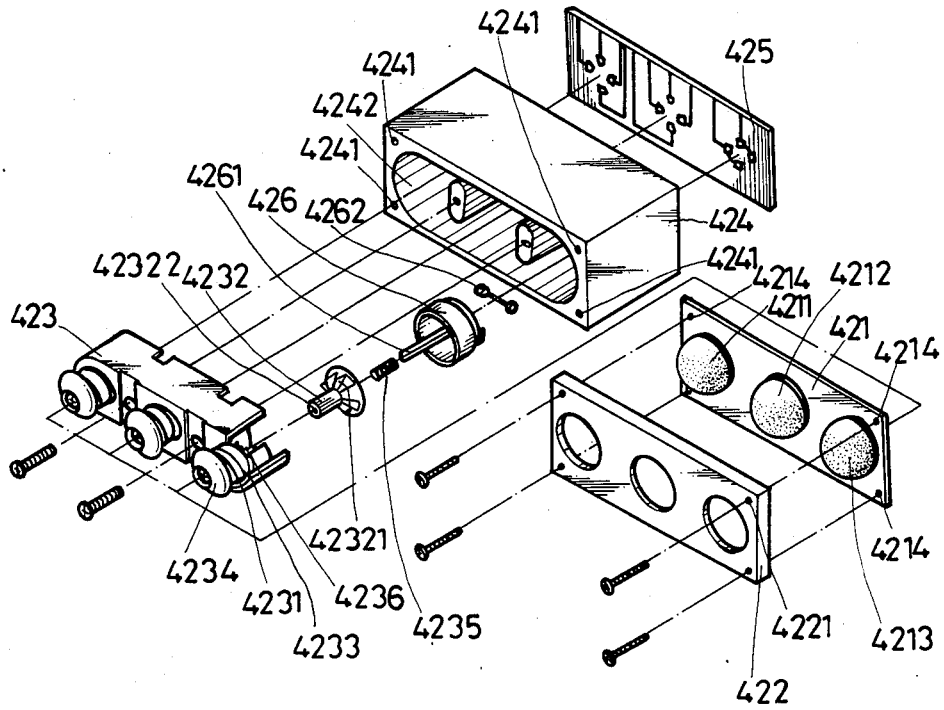
FIG. 2*b* is a exploded view illustrating interior structure of push buttons according to the present invention.

The buttons (42, 43 and 44) on the handle (4) are of identical structure. As shown in FIG. 2*b*, there is a rubber pad (421) above these buttons. The rubber pad (421) has three protrusions (4211, 4212, and 4213) for these three buttons (42, 43, and 44). The rubber pad (421) is placed in a cover (422) and fixed to the fixing block by means of screws passing through the screw holes (4221) of the cover (422), holes (4214) into screw holes (4241) of the fixing block (424).

To fix the cover (422), a support (423) is first fixed in a cavity (4242) of the fixing block (424). There are moving rods (4231) on the support (423). Each moving rod (4231) is incorporated with two conical bodies (4236) of different height, a spring (4233) and an arc plate (4234) to form an assembly which can be placed in a protrusion (4211) of the rubber pad (421). The moving rod (4231) acts as a switch while it is extending or retracting. It has a rotating shaft (4232) with conical bodies (42321) corresponding to the conical bodies (4236) so that the rotating shaft (4232) can turn when the button is pushed. The rotating shaft (4232) has a square hole (42322) for insertion of a stay (4261) with a spring (4235) from a block (426) so that the block (426) can turn following turning of the rotation shaft (4232). A contactor (4262) is located behind the block (426). The contactor (4262) has two circular ends to open and close a printed circuit on a board (425). That it, the circuit is open while the contactor (4262) is at a certain degree, and close while contactor (4262) is at another degree. Therefore, power can be turned on and off by pushing the button (42, 43, or 44).

The cover (5) of the present invention has two fasteners (51 and 51') and two control pates (52 and 52') for fastening the cover (5) to the handle (4) by hooking the fasteners (51 and 51') to two hooks (45) on the handle (4). There is a hole (53) on the cover for inserting of plug for battery charging purpose.

The present invention has LEDs for indication of charging and power of batteries.

What is claimed is:

1. A flashlight with alarm and rescuer which will selectively blink an alarm signal, sound an alarm, and deliver an electrical shock comprising:

a cylindrical casing; a transparent hood surrounding an end of said casing and having a plurality of circumferential openings therethrough;

a colored reflector ring, with a reflector, bulb mounted therein and a lens mounted thereover, said ring, reflector, bulb and lens being disposed within said hood at the end of said casing, and flasher means within said casing coupled to said bulb;

a plurality of biased electrodes, one slidably disposed in each opening in said hood;

first rotatable regulator means surrounding said hood for selectively extending said electrodes through said openings and for retracting said electrodes into said hood, said electrodes being adapted to be charged with an electric current only when depressed in the extended position;

said casing defining a resonance chamber disposed behind said reflector and bulb, adapted to contain an alarm, and sound speaker; and second rotatable means, surrounding said casing for selectively controlling the volume of said alarm;

switch means for selectively delivering an electric current to said flasher, said electrodes, and said alarm.

2. The device of claim 1 wherein said lens has a v-seat for reflecting light from the bulb to the reflector to increase the intensity of the light emitted.

3. The device of claim 1 wherein the reflector defines a plurality of equidistant radial ridges surrounding the bulb to converge light before reflecting in order to increase intensity of the light emitted.

4. The device of claim 1 wherein two openings are disposed in said hood with two electrodes, one in each, each electrode having a needle like end adapted to extend from said hood and an opposite end mounted on said first regulator, said first regulator defining an internal cam surface whereby as said regulator is rotated, said electrodes will ride on said cam surface and move from the retracted position to the extended position.

5. The device of claim 1 wherein said casing defines a plurality of openings surrounding the resonance chamber and said second regulator means selectively opens or closes said openings.

6. The device of claim 1 wherein said switch means comprises three buttons, each mounted on a support with arc plates so that depressing each button either completes or breaks an electrical circuit.

* * * * *